US005914649A

United States Patent [19]

Isono et al.

[11] Patent Number: 5,914,649

[45] Date of Patent: Jun. 22, 1999

[54] CHIP FUSE AND PROCESS FOR PRODUCTION THEREOF

[75] Inventors: Tadashi Isono, Ibaraki-ken; Yoshiyuki Tsuru, Shimodate; Yutaka Taniguchi, Ibaraki-ken; Fumio Suzuki, Hitachi, all of Japan

[73] Assignee: Hitachi Chemical Company, Ltd., Tokyo, Japan

[21] Appl. No.: 08/991,601

[22] Filed: Dec. 16, 1997

[30] Foreign Application Priority Data

Mar. 28, 1997 [JP] Japan ..... 9-076803
Apr. 25, 1997 [JP] Japan ..... 9-108470

[51] Int. Cl.[6] ..... H01H 85/06; H01H 85/046; H01H 85/08

[52] U.S. Cl. ..... 337/290; 337/297; 337/296; 337/295

[58] Field of Search ..... 337/152, 153, 337/160, 182, 183, 184, 185, 221, 290, 297, 416

[56] References Cited

U.S. PATENT DOCUMENTS

| | | | |
|---|---|---|---|
| 4,988,969 | 1/1991 | Gurevich | 337/260 |
| 5,248,852 | 9/1993 | Kumagai | 174/250 |
| 5,446,436 | 8/1995 | Williams | 337/273 |
| 5,586,014 | 12/1996 | Hasegawa | 361/354 |

*Primary Examiner*—Leo P. Picard
*Assistant Examiner*—Anatoly Vortman
*Attorney, Agent, or Firm*—Antonelli, Terry, Stout & Kraus, LLP

[57] ABSTRACT

A chip fuse comprising an organic resin-made insulating substrate, a pair of electrodes formed at terminals of said organic resin-made insulating substrate, current protecting element wiring portions and a current protecting element positioned between said pair of electrodes and housed in said organic resin-made insulating substrate, said current protecting element having a thickness of 3–8 $\mu$m and being supported on an organic resin layer having a high tracking resistance, and at least one space being formed at least on the current protecting element side, does not cause ignition nor smoking and is excellent in clearing characteristics.

21 Claims, 5 Drawing Sheets

CHIP FUSE AND PROCESS FOR PRODUCTION THEREOF

BACKGROUND OF THE INVENTION

The present invention relates to a chip fuse and a process for production thereof.

A current protecting element is used for the purpose of protecting electronic devices against overcurrent. It is inserted between a power circuit and an electric circuit. When an overcurrent arises, the wiring housed in the current protecting element is broken and the current is interrupted, and thereby the electric circuit is protected.

As a common name, such an element is called "fuse". An element can be called fuse only when characteristic properties prescribed in various Standards are fulfilled. In view of the current trend aiming at diversification of electronic devices, there is an increasing demand for a current-protecting element of which characteristic properties are different from those prescribed in the prior art fuse Standards.

As a device for preventing overcurrent, not only the above-mentioned current-protecting element but also electronic switches using thyristor or transistor can be used. Such electronic switches, however, are not suitable for use in the fields requiring a small size and a low consumption of power such as cell-worked portable instruments, because the use of such switches brings about an increased number of circuit parts and an increased consumption of electric power.

Thus, JP-A-60-143544 has disclosed an element prepared by forming on a ceramic substrate a silver layer or a silver-palladium layer as a first conductor layer, a nickel layer as a second conductor layer and a solder layer or a tin layer as a third conductor layer in order to improve the clearing characteristics at the time of soldering. Further, this patent gazette has also disclosed a technique of coating the surface of the conductors with a non-combustible or flame-retardant resin such as silicone resin or the like.

However, the product prepared by providing a current-protecting element (fuse) on a ceramic substrate is disadvantageous in that the ceramic substrate is low in heat resistance and, if the current-protecting element is covered with a non-combustible or flame-retardant resin, it exhibits a high heat dissipation so that the current value of clearing tends to vary depending on the environmental temperature.

In order to solve the above-mentioned problem of ceramic substrate, a method of using an organic resin type insulating substrate has been proposed. This method, however, has a problem in that the substrate resin tends to undergo smoking or ignition when the resin is epoxy resin, phenolic resin, polyimide resin or the like.

SUMMARY OF THE INVENTION

It is an object of the present invention to provide a chip fuse excellent in prevention of smoking and ignition, high in the insulating resistance after clearing and high in reliability, and a process for producing said chip fuse.

The present invention provides a chip fuse comprising an organic resin-made insulating substrate, a pair of electrodes formed at both terminals of said organic resin-made insulating substrate, current protecting element wiring portions and a current protecting element positioned between said pair of electrodes and housed in the organic resin-made insulating substrate, said current protecting element having a thickness of 3–8 $\mu$m and being supported on an organic resin layer having a high tracking resistance, and at least one space being formed at least on the current protecting element side.

Further, the present invention provides a process for producing the above-mentioned chip fuse.

BRIEF DESCRIPTION OF THE DRAWINGS

FIGS. 1A through 1H are drawings illustrating one embodiment of the present invention in which a space is provided on the current protecting element side, wherein FIGS. 1A and 1C to 1G are sectional views and FIGS. 1B and 1H are plan views.

FIGS. 3A through 3G are sectional views at AA plane, illustrating an embodiment of the present invention in which spaces are provided both on the current protecting element side and on the organic resin layer side, wherein

DESCRIPTION OF THE PREFERRED EMBODIMENTS

Figure 5:
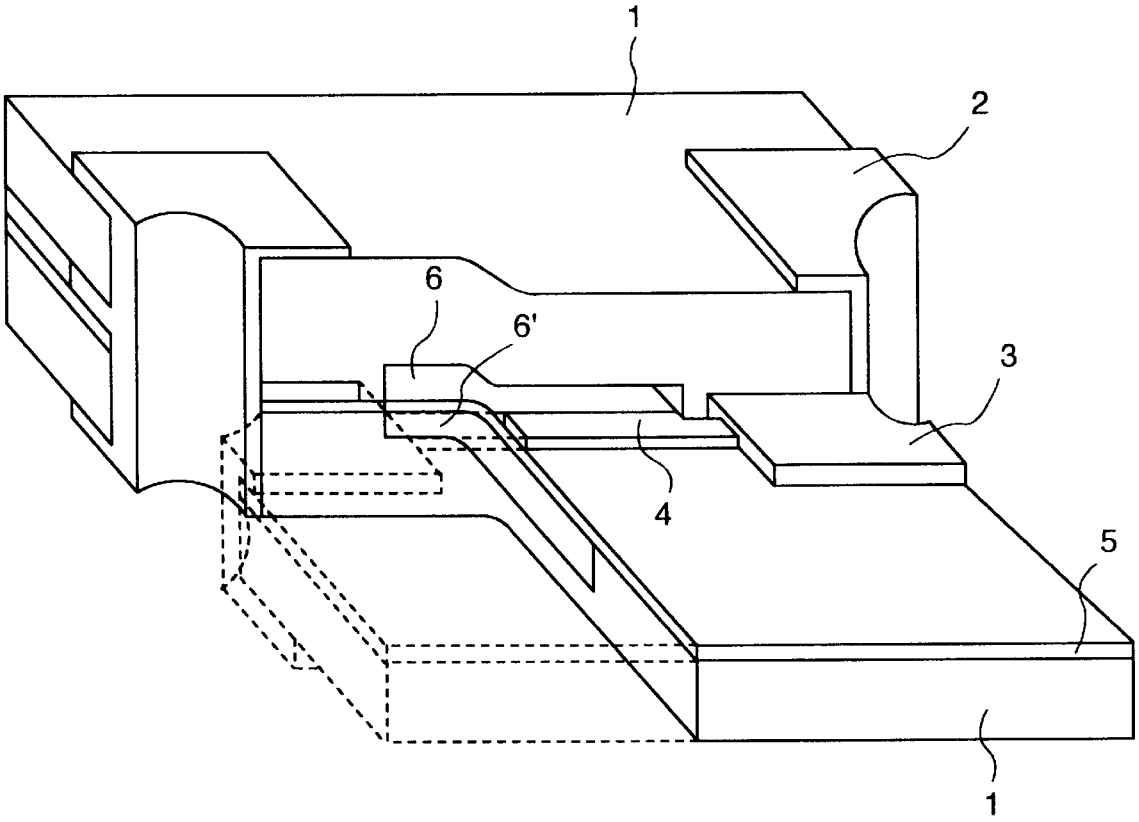
FIG. 5 is a partially cutaway perspective view illustrating one embodiment of the chip fuse of the present invention.

As shown in FIG. 5, the chip fuse of the present invention comprises an organic resin-made insulating substrate (1), a pair of electrodes (2) formed at both terminals of the organic resin-made insulating substrate (1), a current protecting element wiring portion (3) housed in the organic resin-made insulating substrate (1) and a current protecting element (4), provided that the current protecting element (4) is supported on an organic resin layer (5) having a high tracking resistance, a space (6) is provided on the current protecting element (4) side or spaces (6,6') are provided on both the current protecting element (4) side and the organic resin layer (5) side, and thickness of the current protecting element (4) is in the range of 3–8 $\mu$m.

Figure 1A:
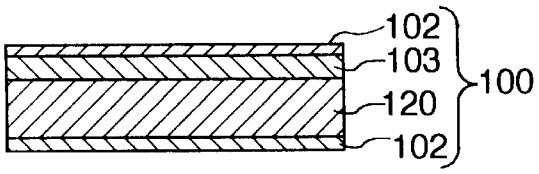
Figure 1B:
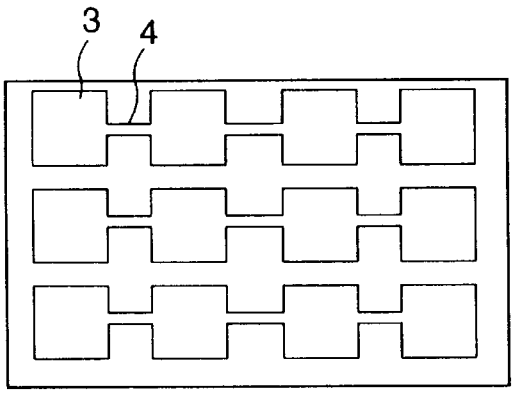
Figure 1C:
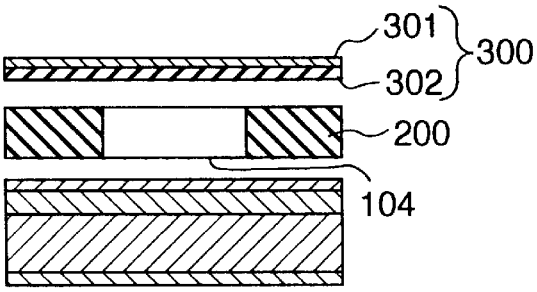
Figure 1D:
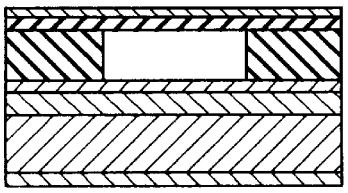
Figure 1E:
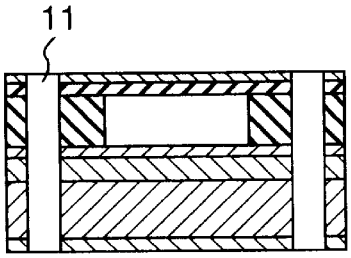
Figure 1F:
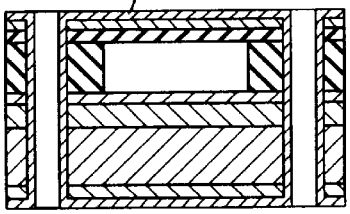
Figure 1G:
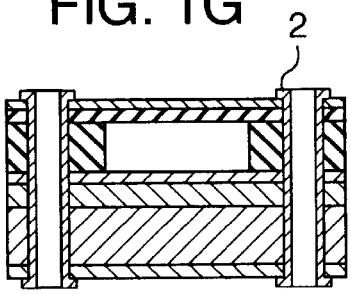
Figure 1H:
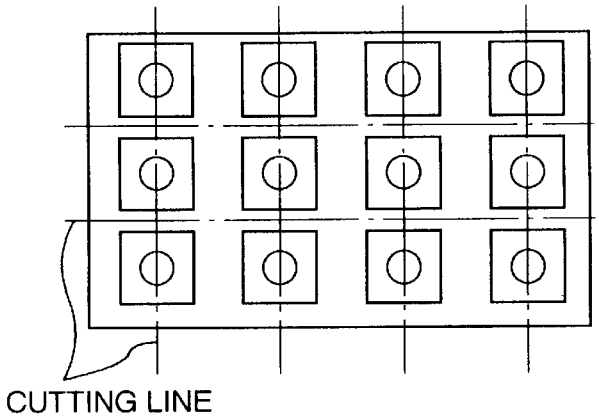

A chip fuse having a space (6) only on the current protecting element (4) side can be produced, for example, according to the steps mentioned below:

a) a step of forming an organic resin layer (103) having a high tracking resistance on one side of copper foil (102) having a thickness of 3–8 $\mu$m and laminating a substrate (120) having copper foil (102) on the organic resin layer (103) side thereof to prepare a laminate (100), as shown in FIG. 1A;

b) a step of etching off unnecessary portions of the copper foil (102) of the laminate (100) and thereby forming a plurality of current protecting element wiring portions (3) and current protecting elements (4), as shown in FIG. 1B;

c) apart from the above, a step of preparing insulating spacer (200) having holes (104) (not shown in the drawings);

d) a step of superposing the insulating spacer (200) having hole (104) obtained in Step c) on the current protecting element (4) side of the laminate (100) on which current protecting element wiring portions (3) and current protecting elements (4) have been formed in step b), further superposing thereon a laminate (300) having insulating layer (302) formed on one side of copper foil (301) so that the insulating layer (302) comes into contact with insulating spacer (200) as shown in FIG. 1C, and carrying out lamination as shown in FIG. 1D;

e) a step of boring or drilling holes (11) so that the holes pass through the current protecting element wiring portion (3) of the laminated product, as shown in FIG. 1E;

f) a step of forming a plating layer (12) on the laminated product having holes (11) to make the inner walls of the holes electrically conductive, as shown in FIG. 1F;

g) a step of etching off unnecessary portions of the copper and thereby forming electrodes (2) connected to the conductive material on the inner wall of the holes (11), as shown in FIG. 1G; and h) a step of cutting the holes (11) in the longitudinal direction and thereby dividing the assembly into individual chips in which the cutout pieces of the holes function as terminal electrodes (2), as shown in FIG. 1H.

If desired, a step of forming a plating layer of 10 to 50 μm thick on the portions expected to form the current protecting element wiring portion (3) of the copper foil (12) having a thickness of 3–8 μm may be inserted between the above-mentioned Step a) and Step b).

Further, if desired the above-mentioned process may be altered to a process for producing a chip fuse comprising the following steps (also see FIGS. 2A, 2B and 2C):

a1) a step of preparing a laminate by coating an organic resin varnish onto the second copper layer (112) side of a composite metallic foil (110) constituted of a first copper layer (111) having a thickness of 10–50 μm, a second copper layer (112) having a thickness of 3–8 μm and an intermediate layer (113) made of nickel or an alloy thereof and having a thickness of 1 μm or less, said intermediate layer being positioned between the two copper layers, drying the varnish to form an organic resin layer (103) having a high tracking resistance so that the organic resin layer (103) comes into contact with substrate (120), and further laminating thereon a copper foil (102);

a2) a step of etching off only the first copper layer (111);

a3) a step of further etching off only the intermediate layer (113);

b1) a step of etching off the unnecessary portions of the second copper layer (112) and thereby forming a plurality of current protecting element wiring portions (3) and current protecting elements (4);

c) apart from the above, a step of preparing an insulating spacer (200) having holes (104);

d1) a step of superposing the insulating spacer (200) having holes (104) prepared in Step c) on the current protecting element (4) side of the product on which current protecting element wiring portions (3) and current protecting elements (4) have been formed in Step b1), further superposing thereon a laminate (300) having an insulating layer (302) on one side of copper foil (301) so that the insulating layer (302) comes into contact with insulating spacer (200), and carrying out lamination;

e) a step of boring holes (11) through the laminated product obtained above so that the holes (11) pass through the current protecting element wiring portions (3) of the laminated product;

f) a step of forming a plating layer (12) onto the laminated product having holes (11) to make the inner walls of holes (11) electrically conductive;

g) a step of etching off the copper from the unnecessary portions and thereby forming electrodes (2) connected to the conductive material of the inner walls of holes (11); and h) a step of cutting the holes (11) in the longitudinal direction to divide the assembly into individual chip fuses in which the cutout pieces of the holes function as terminal electrodes (2).

Figure 2A:
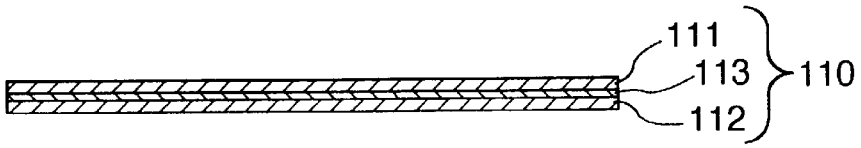
FIGS. 2A through 2E are sectional views illustrating another embodiment of the present invention in which a space is provided on the current protecting element side.
Figure 2B:
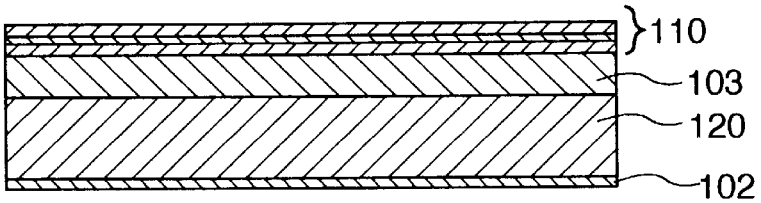
Figure 2C:
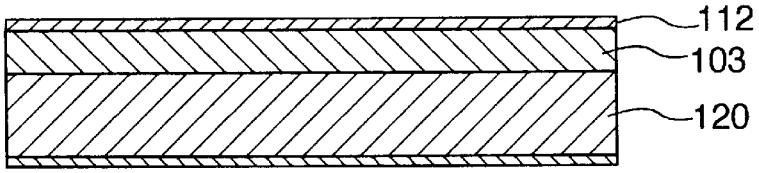
Figure 2D:
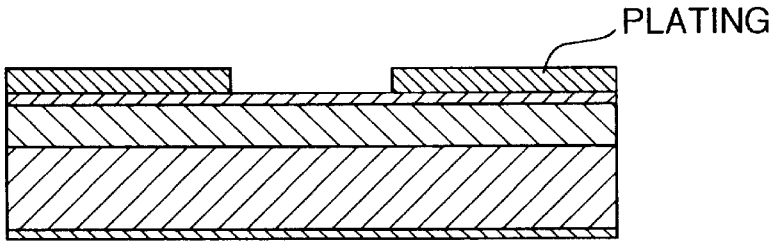

If desired a step of forming a plating layer of 10 to 50 μm thick on the portions expected to form current protecting element wiring portion (3) of the copper foil (112) having a thickness of 3–8 μm may be inserted between the above-mentioned Step a3) and Step b1)(FIG. 2D).

Further, a chip fuse having space (6) only on the current protecting element (4) side can be obtained by a process comprising the following steps, too:

a1) a step of preparing a laminate (100) by coating an organic resin varnish onto the second copper layer (112) side of a composite metallic foil (110) constituted of a first copper layer (111) having a thickness of 10–50 μm, a second copper layer (112) having a thickness of 3–8 μm and an intermediate layer (113) made of nickel or an alloy thereof and having a thickness of 1 μm or less, said intermediate layer being positioned between the two copper layers, drying the varnish to form an organic resin layer (103) having a high tracking resistance so that organic resin layer (103) comes into contact with substrate (120), further laminating thereon a copper foil (102), and carrying out lamination;

a4) a step of etching off at least the portions expected to form current protecting elements (4) from the first copper layer (111);

a5) a step of etching off the portions which has been exposed in Step a4) from the intermediate layer (113) of the composite metallic foil (110);

b2) a step of etching off unnecessary portions from the second copper layer (112) and thereby forming current protecting element wiring portions (3) and current protecting elements (4);

c) apart from the above, a step of preparing an insulating spacer (200) having holes (104);

d2) a step of superposing the insulating spacer (200) having holes (104) prepared in Step c) on the current protecting element (4) side of the product on which current protecting element wiring portions (3) and current protecting elements (4) have been prepared in Step b2), further superposing thereon a laminate (300) prepared by forming insulating layer (302) on one side of copper foil (301) so that the insulating layer (302) comes into contact with insulating spacer (200), and then carrying out lamination;

e) a step of boring holes (11) through the laminated product thus obtained so that the holes pass through the current protecting element wiring portions (3) of the laminated product;

f) a step of forming a plating layer (12) on the laminated product having holes (11) obtained above to make the inner walls of the holes (11) electrically conductive;

g) a step of etching off the copper from the unnecessary portions and thereby forming electrodes (2) connected to the conductive material of the inner walls of holes (11); and h) a step of cutting the holes (11) in the longitudinal direction and thereby dividing the assembly into individual chip fuses in which the cutout pieces of the holes function as terminal electrodes (2).

Figure 3A:
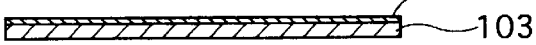
Figure 3B:
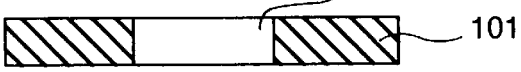
Figure 3C:
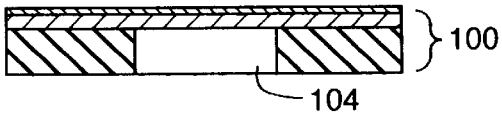
Figure 3D:
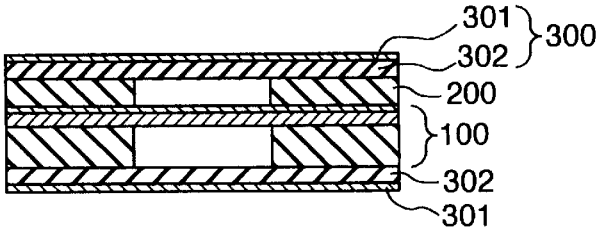
Figure 3E:
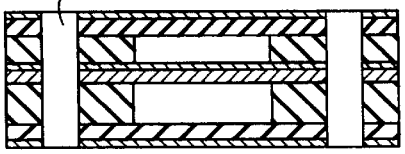
Figure 3F:
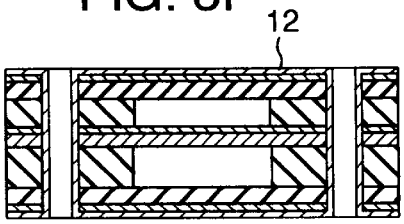
Figure 3G:
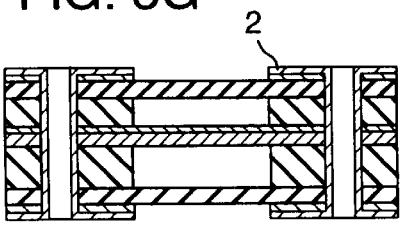
Figure 3H:
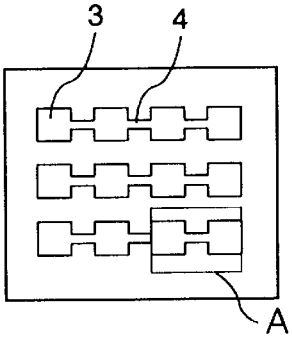
FIGS. 3H and 3J are plan views and FIG. 3I is an expanded sectional view of A of FIG. 3H at AA plane.
Figure 3I:
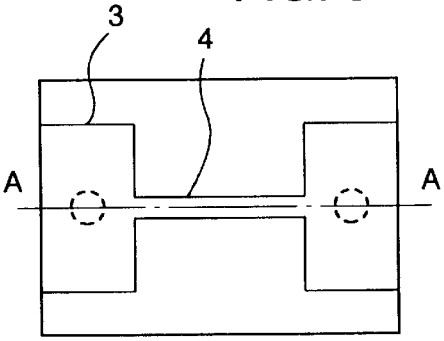
Figure 3J:
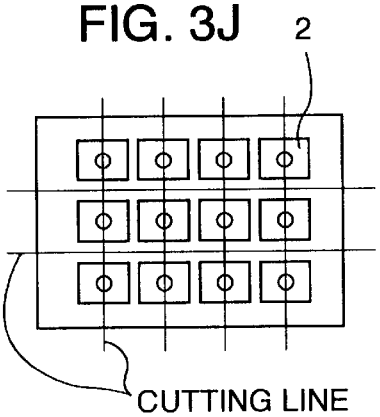

A chip fuse having a space (6) on the current protecting element (4) side and a space (6') on the organic resin layer (5) side can be obtained, for example, by a process comprising the following steps:

a') a step of preparing insulating spacer (101) having holes (104) as shown in FIG. 3B;

b') a step of laminating the insulating spacer (101) having holes (104) obtained above onto the organic resin layer (103) side of a product prepared by forming an organic resin layer (103) having a high tracking resistance on one side of a copper foil (102) having a thickness of 3–8 μm as shown in FIG. 3A and thereby preparing a laminate (100) as shown in FIG. 3C;

c') a step of etching off unnecessary portions of copper foil (102) from the laminate (100) and thereby forming a plurality of current protecting element wiring portions (3) and current protecting elements (4), as shown in FIGS. 3H and 3I;

d') apart from the above-mentioned steps, a step of preparing an insulating spacer (200) having holes (104) (not shown in the drawings);

e') a step of superposing the insulating spacer (200) having holes (104) prepared in Step d') on the current protecting element (3) side of the laminate (100) on which current protecting element wiring portions (3) and current protecting elements (4) have been formed in Step c'), further superposing thereon a laminate (300) prepared by forming an insulating layer (302) on one side of a copper foil (301) so that the insulating layer (302) comes into contact with insulating spacer (200), and carrying out lamination, as shown in FIG. 3D;

f') a step of boring holes (11) so that the holes pass through the current protecting element wiring portions (3) of the laminated product, as shown in FIG. 3E;

g') a step of forming a plating layer (12) on the laminate having holes (11) to make the inner walls of the holes (11) electrically conductive, as shown in FIG. 3F;

h') a step of etching off the copper of unnecessary portions and thereby forming electrodes (2) connected to the conductive material on the inner walls of holes (11), as shown in FIG. 3G; and i') a step of cutting the holes (11) in the longitudinal direction and thereby dividing the assembly into individual chip fuses in which the cutout pieces of the holes function as terminal electrodes (2)(FIG. 3J).

If desired, a step of forming a plating layer of 10 to 50 μm thick on the portions expected to form current protecting element wiring portions (3) of copper foil (12) having a thickness of 3–8 μm may be inserted between Step b') and Step c').

Furthers if desired, the above-mentioned process may be altered to a process comprising the following steps (also see FIGS. 4A, 4B and 4C):

a') a step of preparing an insulating spacer (101) having holes (104);

b1') a step of preparing a laminate (100) by coating an organic resin varnish onto the second copper layer (112) side of a composite metallic foil (110) constituted of a first copper layer (111) having a thickness of 10–50 μm, a second copper layer (112) having a thickness of 3–8 μm and an intermediate layer (113) made of nickel or an alloy thereof and having a thickness of 1 μm or less, said intermediate layer being positioned between the two copper layers, and drying the varnish to form an organic resin layer (103) having a high tracking resistance, and then carrying out lamination so that the organic resin layer (103) comes into contact with the insulating spacer (101) having holes (104);

b2') a step of etching off only the first copper layer (111);

b3') a step of further etching off only the intermediate layer (113);

c1') a step of etching off the unnecessary portions of the second copper layer (112) and thereby forming a plurality of current protecting element wiring portions (3) and current protecting elements (4);

d') apart from the above, a step of preparing an insulating spacer (200) having holes (104);

e1') a step of superposing the insulating spacer (200) having hole (104) prepared in Step d') on the current protecting element (4) side of the product prepared by forming current protecting element wiring portions (3) and current protecting elements (4) in Step c1'), further superposing thereon a laminate (300) having an insulating layer (302) on one side of a copper foil (301) so that the insulating layer (302) comes into contact with the insulating spacer (200), and then carrying out lamination;

f') a step of boring holes (11) so that the holes pass through the current protecting element wiring portions (3) of the laminated product;

g') a step of forming a plating layer (12) onto the laminated product having holes (11) to make the inner walls of the holes (11) electrically conductive;

h') a step of etching off copper of the unnecessary portions and thereby forming electrodes (2) connected to the conductive material of the inner walls of holes (11); and i') a step of cutting the holes (11) in the longitudinal direction and dividing the assembly into individual chip fuses so that the cutout pieces function as terminal electrodes (2).

Figure 4A:
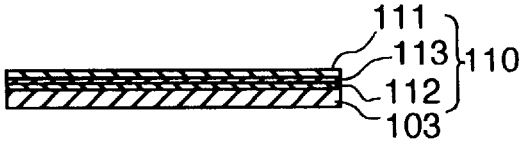
FIGS. 4A through 4E are sectional views illustrating another embodiment of the present invention in which spaces are provided both on the current protecting element side and on the organic resin layer side.
Figure 4B:
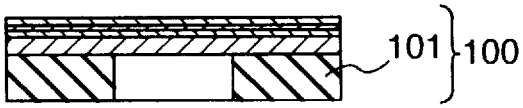
Figure 4C:
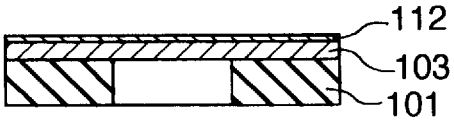
Figure 4D:
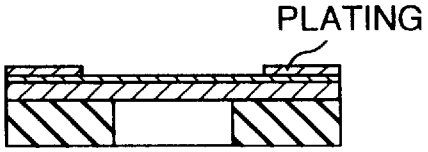

If desired, a step of forming a plating layer 10 to 50 μm thick on the portions expected to form current protecting element wiring portions (3) of the copper foil (102) having a thickness of 3–8 μm may be inserted between Step b3') and Step c1')(FIG. 4D).

Further, a chip fuse having spaces on both of the current protecting element (4) side and the organic resin layer (5) side can be produced also by a process comprising the following steps:

a') a step of preparing insulating spacer (101) having holes (104);

b1') a step of preparing laminate (100) by coating an organic resin varnish onto the second copper layer (112) side of a composite metallic foil (110) constituted of a first copper layer (111) having a thickness of 10–50 μm, a second copper layer (112) having a thickness of 3–8 μm and an intermediate layer (113) made of nickel or an alloy thereof and having a thickness of 1 μm or less, said intermediate layer being positioned between the two copper layers, and drying the varnish to form an organic resin layer (103), and then carrying out lamination so that the organic resin layer (103) comes into contact with the insulating spacer (101) having holes (104);

b4') a step of etching off at least the portions expected to form current protecting elements (4) from the first copper layer (111);

b5') a step of further etching off the portions which have been exposed in Step b4'), from the intermediate layer (113) of the composite metallic foil (110);

c2') a step of etching off unnecessary portions from the second copper layer (112) and thereby forming current protecting element wiring portions (3) and current protecting elements (4);

d') apart from the above, a step of preparing an insulating spacer (200) having holes (104);

e2') a step of superposing the insulating spacer (200) having holes (104) prepared in Step d') on the current protecting element (4) side of the product on which current protecting element wiring portions (3) and current protecting elements (4) have been formed in Step c2'), and superposing thereon a laminate (300) prepared by forming an insulating layer (302) on one side of a copper foil (301) so that the insulating layer (302) comes into contact with insulating spacer (200), and carrying out lamination;

f') a step of boring holes (11) so that the holes pass through the current protecting element wiring portions (3) of the laminated product;

g') a step of forming a plating layer (12) on the laminate through which the holes (11) have been bored to make the inner walls of the holes (11) electrically conductive;

h') a step of etching off copper of unnecessary portions and thereby forming electrodes (2) connected to the conductive material on the inner walls of holes (11); and i') a step of cutting the holes (11) in the longitudinal direction and thereby dividing the assembly into individual chip fuses in which the cutout pieces of the holes function as the terminal electrodes (2).

The space which is to be provided only on the current protecting element (4) side or on both the current protecting element (4) side and the organic resin layer (5 or 103) side may have any shape, unless the shape deteriorates mechanical strength of chip fuse and deteriorates the controllability of continuity resistance of current protecting element and the clearing characteristics under overcurrent.

It is necessary in the present invention that the organic resin layer (103) contacted with the current protecting element wiring portion (3) has a high tracking resistance.

The term "tracking resistance" means a degree in which formation of tracking (track of passage of current) is prevented when a voltage is applied to the surface. The tracking resistance should preferably be that of PLC-0 class as determined according to the "Method for Determining Comparative Tracking Index and Guaranteed Tracking Index of Solid Insulating Materials in Humid State" mentioned in IEC Publication (Standard Officially Recommended by the International Electrical Standard Congress) 112. As prescribed in IEC Publication 112, this is an index of tracking property expressed by the voltage forming a permanent carbonized electroconductive path when 50 drops of electrolytic solution has been dropped between electrodes having a form of test piece under a voltage-input condition at a rate of one drop per 30 seconds. PLC-0 class means that the material has a sufficient tracking resistance even at an applied voltage of 600 V or above.

Thickness of the organic resin layer (103) is preferably in the range of from 5 $\mu$m to 200 $\mu$m, and more preferably from 20 $\mu$m to 100 $\mu$m. If the thickness of organic resin layer is smaller than 5 $\mu$m, no sufficient tracking resistance can be exhibited. If the thickness is larger than 200 $\mu$m, the effect of the space located in the resin side decreases.

The organic resin layer (103) can be formed by coating a varnish onto the copper foil on which current protecting element wiring portions (3) and current protecting elements (4) are to be formed. Otherwise, the organic resin layer (103) can be formed also by coating a PET film or the like with an organic resin varnish to prepare an organic resin film, followed by pasting the organic resin film to the copper foil on which current protecting element wiring portions (3) and current protecting elements (4) are to be formed.

The organic resin layer (103) can comprises a thermosetting resin and additives such as curing agent, etc. For example, it can be formed from a polyvinyl butyral resin, a n-butylated melamine resin, an o-cresol novolak type epoxy resin, adipic acid, dimethyltriaminethiol and pyrogallol. A preferable formulation thereof is as follows: polyvinyl butyral resin 80–160 parts by weight, n-butylated melamine resin 60–90 parts by weight, o-cresol novolak type epoxy resin 15–30 parts by weight, adipic acid 0.8–1.2 parts by weight, dimethyltriamine thiol 0.4–0.6 part by weight, and pyrogallol 1.2–1.8 parts by weight.

If the thickness of the current protecting element (4) is smaller than 3 $\mu$m, accuracy of the thickness is difficult to control and formation of pinholes is unavoidable. If thickness of the current protecting element (4) is greater than 8 $\mu$m, accuracy of the thickness is difficult to control and the clearing cannot take place with high accuracy when an overcurrent arises. Further, when the apparatus is a portable type of apparatus using a cell, the clearing current is in the range of 600–2,000 mA and therefore the thickness should preferably be in the range of 3–8 $\mu$m in order to form such a clearing current circuit.

If the thickness of the current protecting element wiring portions (3) is too small, the area usable for connection with electrode portions is too small, due to which a high resistance arises. Since a chip fuse is usually connected to the electric source side of the current, the high resistance brings about an undesirable drop in the voltage of electric source. If the thickness of the current protecting wiring portions (3) is too great, the current protecting element wiring portions are difficult to fabricate. Accordingly, thickness of the current protecting element wiring portions is preferably in the range of 10–50 $\mu$m.

When the space (6) is formed only in the current protecting element wiring portion (4) side, the above-mentioned thickness of current protecting element wiring portions can be attained by inserting, between Step b) and Step c), a step of forming a plating layer of 10 to 50 $\mu$m thick on the portions of the copper foil having a thickness of 3–8 $\mu$m which is expected to form current protecting element wiring portions (3), as shown in FIG. 2D.

Figure 2E:
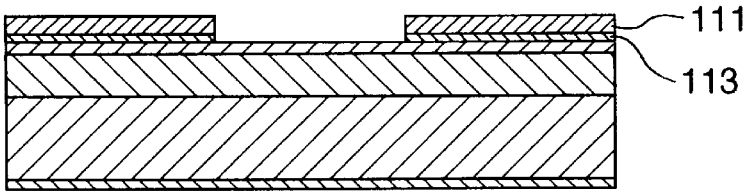

Alternatively, the above-mentioned thickness of current protecting element wiring portions can be attained by leaving the first copper layer (111) as it is at the time of using the above-mentioned three-layered composite metallic foil (110). This can be achieved by inserting the following Steps a4) and a5) after the Step a1):

a4) a step of etching off the first copper layer (111) at least from the portions which are expected to form current protecting elements (4); and a5) a step of etching off the intermediate layer (113) from the portions exposed in the preceding step, as shown in FIG. 2E.

On the other hand, when spaces are provided on both the current protecting element (4) side and the organic resin layer (5) side, the thickness of the current protecting element wiring portions (3) can be adjusted to 10–50 $\mu$m by inserting, between Step b') and Step c'), a step of forming a plating layer of 10 to 50 $\mu$m thick on the portions which are expected to form current protecting element wiring portions (3).

Figure 4E:
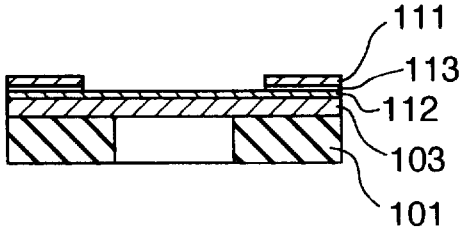

Alternatively, the above-mentioned thickness of current protecting element wiring portions can be attained by leaving the first copper layer (111) as it is at the time of using the above-mentioned three-layered composite metallic foil (110). This can be achieved by inserting the following Steps b4') and b5') after the Step b1'):

b4') a step of etching off the first copper layer (111) at least from the portions which are expected to form current protecting elements (4); and b5') a step of etching off the intermediate layer (113) from the portions exposed in the preceding step, as shown in FIG. 4E.

Resin flow of the insulating spacer (200) having hole (104) or insulating spacer (101) used in Step c) or Step a') is preferably 200 μm or less. As the insulating material thereof, any of prepreg and resin film may be used, so far as resin flow at the time of lamination is 200 μm or less. As commercially available prepreg, for example, GEA-E-679N (a trade name, manufactured by Hitachi Chemical Co., Ltd.) can be referred to. As commercially available resin film, for example, GF3500 (a trade name, manufactured by Hitachi Chemical Co., Ltd.) can be referred to.

If desired, a method of bonding a cured insulating material by the use of an adhesive can also be adopted. The resin flow into hole can be decreased by making thickness of adhesive layer smaller and boring a hole through the adhesive layer simultaneously with the insulating material. As said cured insulating material, those obtained by etching off the copper foil from the copper-clad laminate used in usual wiring boards can be used. As the adhesive, those made of the same type of material as the insulating material and having an excellent adhesiveness to the insulating material can be used. Alternatively, the same resins as used in the above-mentioned organic resin layer having a high tracking resistance may also be used.

Next, the present invention is explained more concretely by referring to the following Examples, wherein Examples 1–4 illustrate the cases of providing a space only in the current protecting element side, while Examples 5–8 illustrate the cases of providing spaces in both the current protecting element side and the organic resin layer side.

EXAMPLE 1

As an organic resin layer (103), an organic resin film having a thickness of 50 μm was prepared by dissolving 120 parts by weight of polyvinyl butyral resin, 74 parts by weight of n-butylated melamine resin, 20 parts by weight of o-cresol novolak type epoxy resin, 1 part by weight of adipic acid, 0.5 part by weight of dimethyltriamine-thiol and 1.5 parts by weight of pyrogallol in a solvent mixture containing 250 parts by weight of methanol, 190 parts by weight of methyl ethyl ketone and 190 parts by weight of toluene to prepare a resin varnish, followed by coating on a PET film with the varnish and drying the coating first at 80° C. for 5 minutes and then at 140° C. for 5 minutes.

Then, the organic resin film obtained above was inserted between copper foil (102) having a thickness of 5 μm on which the current protecting element wiring portions (3) and the current protecting elements (4) were to be formed and substrate (120) (MCL-E-679, a trade name, single-sided copper-clad laminate having a thickness of 0.2 mm, manufactured by Hitachi Chemical Co., Ltd.), and lamination was carried out with heating and pressing at a temperature of 170° C., for 60 minutes, under a pressure of 50 kg/cm$^2$ to obtain a laminate (100), as shown in FIG. 1A.

Then, as shown in FIG. 2D, thickness of the portions corresponding to current protecting element wiring portions (3) was increased by 10 μm by electroplating of copper.

Then, an ultraviolet-curable resist was electrodeposited, baked and developed to form an etching resist, and the unnecessary portions of copper foil (102) was etched off to form a pattern of current protecting element wiring portions (3) and current protecting elements (4).

In the pattern thus formed, a plurality of current protecting element wiring portions (3) were arranged in series in the longitudinal direction so as to interpose the current protecting elements (4), and in parallel with one another in the lateral direction, as shown in FIG. 1B.

Apart from the above, insulating spacer (200) was prepared by superposing an adhesive sheet having a thickness of 25 μm (GF3500, a trade name, manufactured by Hitachi Chemical Co., Ltd.) on both sides of a product prepared by etching off the copper foil from both sides of a double-sided copper-clad laminate having a thickness of 0.2 mm (MCL-E-679, trade name, manufactured by Hitachi Chemical Co., Ltd.) and drilling space-forming holes (104) having a diameter of 0.8 mm by means of a drill.

Then, as shown in FIG. 1C, the spacer (200) having holes (104) was superposed on the product on which current protecting element wiring portions (3) and current protecting elements (4) had been formed, and a single-sided copper-clad (18 μm in thickness) laminate having a thickness of 0.2 mm (MCL-E-679, a trade name, manufactured by Hitachi Chemical Co., Ltd.) as the laminate (300) was further superposed thereon so that the copper foil (301) faced outside, and the assembly so formed was laminated with heating and pressing at a temperature of 180° C. for 90 minutes under a pressure of 50 kg/cm$^2$ to obtain a laminate, as shown in FIG. 1D.

Then, holes (11) for connection were drilled through the laminated product thus obtained as shown in FIG. 1E, plating (12) was carried out to make the inner wall of holes (11) electrically conductive as shown in FIG. 1F, and thereafter electrodes (2) were formed by etching off the copper from the unnecessary portions as shown in FIG. 1G. Thus, a substrate for chip fuses was prepared.

EXAMPLE 2

As an organic resin layer (103), an organic resin film having a thickness of 50 μm was prepared by dissolving 120 parts by weight of polyvinyl butyral resin, 74 parts by weight of n-butylated melamine resin, 20 parts by weight of o-cresol novolak type epoxy resin, 1 part by weight of adipic acid, 0.5 part by weight of dimethyltriamine-thiol and 1.5 parts by weight of pyrogallol in a solvent mixture consisting of 250 parts by weight of methanol, 190 parts by weight of methyl ethyl ketone and 190 parts by weight of toluene to prepare a resin varnish, coating a PET film with the resin varnish, and drying the coating first at 80° C. for 5 minutes and thereafter at 140° C. for 5 minutes.

Then, the organic resin film obtained above was inserted between copper foil (102) having a thickness of 5 μm on which the current protecting element wiring portions (3) and the current protecting elements (4) were to be formed and substrate (120) (MCL-E-679, a trade name, single-sided copper-clad laminate having a thickness of 0.2 mm, manufactured by Hitachi Chemical Co., Ltd.), and lamination was carried out with heating and pressing at a temperature of 170° C. for 60 minutes, under a pressure of 50 kg/cm$^2$ to obtain laminate (100).

Then, as shown in FIG. 2D, thickness of the portions corresponding to current protecting element wiring portions (3) was increased by 10 μm by electroplating of copper.

Then, an etching resist was formed by laminating SR-3000 (a trade name, ultraviolet-curable resist film, manufactured by Hitachi Chemical Co., Ltd.), followed by baking and development. By etching off the unnecessary portions from copper foil (102), a pattern of current protecting element wiring portions (3) and current protecting elements (4) was formed.

In the pattern thus formed, a plurality of current protecting element wiring portions (3) were arranged in series in the longitudinal direction so as to interpose the current protecting elements (4) and in parallel with one another in the lateral direction.

Apart from the above, an insulating spacer (200) was prepared by superposing an adhesive sheet having a thickness of 25 μm (GF3500, a trade name, manufactured by Hitachi Chemical Co., Ltd.) on both sides of a product prepared by etching off the copper foil from both sides of a double-sided copper-clad laminate having a thickness of 0.2 mm (MCL-E-679, a trade name, manufactured by Hitachi Chemical Co., Ltd.) and drilling space-forming holes (104) having a diameter of 0.8 mm.

Then, the spacer (200) having holes (104) was superposed on the product on which current protecting element wiring portions (3) and current protecting elements (4) had been formed, and a single-sided copper-clad (18 μm in thickness) laminate having a thickness of 0.2 mm (MCL-E-679, a trade name, manufactured by Hitachi Chemical Co., Ltd.) was further superposed thereon as laminate (300) so that the copper foil (301) faced outside, and lamination was carried out with heating and pressing at a temperature of 180° C. for 90 minutes under a pressure of 50 kg/cm$^2$.

Then, holes (11) for connection, having a diameter of 0.8 mm, were drilled through the laminated product thus obtained, plating (12) was carried out to make the inner wall of holes (11) electrically conductive, and thereafter electrodes (2) were formed by etching off the copper of the unnecessary portions.

Then, a substrate for chip fuses were prepared in the same manner as described in Example 1.

EXAMPLE 3

As shown in FIG. 2A, a composite metallic foil constituted of a first copper layer (111) having a thickness of 15 μm, a second copper layer (112) having a thickness of 5 μm and an intermediate nickel-phosphorus alloy layer (113) having a thickness of 0.2 μm and interposed between the two copper layers was prepared.

A resin varnish was prepared by dissolving 120 parts by weight of polyvinyl butyral resin, 74 parts by weight of n-butylated melamine resin, 20 parts by weight of o-cresol novolak type epoxy resin, 1 part by weight of adipic acid, 0.5 part by weight of dimethyltriamine-thiol and 1.5 parts by weight of pyrogallol in a solvent mixture consisting of 250 parts by weight of methanol, 190 parts by weight of methyl ethyl ketone and 190 parts by weight of toluene. The resin varnish was coated onto the second copper layer (112) side of the composite metallic foil obtained above and dried first at 80° C. for 5 minutes and thereafter at 140° C. for 5 minutes to obtain a composite metallic foil carrying a 50 μm organic resin layer.

As shown in FIG. 2B, the resin layer-carrying copper layer obtained above was superposed on substrate (120) which was a single-sided copper-clad laminate having a thickness of 0.2 mm (MCL-E-679, a trade name, manufactured by Hitachi Chemical Co., Ltd.), so that the resin surfaces thereof faced each other, and lamination was carried out integrally with heating and pressing at 170° C. for 60 minutes under a pressure of 50 kgf/cm$^2$.

Then, the first copper layer (111) was etched off and further the intermediate layer (113) was etched off to expose the second copper layer (112), as shown in FIG. 2C. Then, the unnecessary portions of the second copper layer (112) was etched off in the same manner as in Example 1 to form a plurality of current protecting elements (4), and thickness of copper in current protecting element wiring portions (3) was increased by 10 μm by eletroplating of copper, as shown FIG. 2D.

Thereafter, the procedure of Example 1 was repeated to obtain substrate for chip fuses.

EXAMPLE 4

A composite metallic foil constituted of a first copper layer (111) having a thickness of 15 μm, a second copper layer (112) having a thickness of 5 μm and an intermediate nickel-phosphorus alloy layer (113) having a thickness of 0.2 μm, interposed between the two copper layers, was prepared.

A resin varnish was prepared by dissolving 120 parts by weight of polyvinyl butyral resin, 74 parts by weight of n-butylated melamine resin, 20 parts by weight of o-cresol novolak type epoxy resin, 1 part by weight of adipic acid, 0.5 part by weight of dimethyltriamine-thiol and 1.5 parts by weight of pyrogallol in the same solvent mixture as used in Example 3. The resin varnish thus obtained was coated onto the second copper layer (112) side of the composite metallic foil obtained above and dried first at 80° C. for 5 minutes and thereafter at 140° C. for 5 minutes to obtain a copper foil carrying a 50 μm organic resin layer.

The resin layer-carrying copper foil obtained above was superposed on substrate (120) which was a single-sided copper-clad laminate having a thickness of 0.2 mm (MCL-E-679, a trade name, manufactured by Hitachi Chemical Co., Ltd.), so that the resin surfaces thereof faced each other, and lamination was carried out integrally with heating and pressing at 170° C. for 60 minutes under a pressure of 50 kgf/cm$^2$.

Then, the first copper layer (111) was etched off from the portions not forming the current protecting element wiring portions (3) and further the exposed intermediate layer (113) was etched off to expose the second copper layer (112). Then, the unnecessary portions of the second copper layer (112) was etched off in the same manner as in Example 1 to form a plurality of current protecting elements (4), as shown in FIG. 2E.

Thereafter, the procedure of Example 1 was repeated to obtain a substrate for chip fuses.

The chip fuses prepared in Examples 1–4 were cut along the cutting line shown in FIG. 1H so as to give current protecting element units.

The current protecting elements thus formed had a conductor width of 0.05 mm, and resistance thereof was about 180 mΩ.

Clearing test was carried out on 20 test pieces for every sample. As a result, the resistance after clearing was more than 10 megohms, and on the level of gigaohm in most cases.

No ignition nor smoking was observed in all the samples.

EXAMPLE 5

As an organic resin layer (103), an organic resin film having a thickness of 50 μm was prepared by dissolving 120 parts by weight of polyvinyl butyral resin, 74 parts by weight of n-butylated melamine resin, 20 parts by weight of o-cresol novolak type epoxy resin, 1 part by weight of adipic acid, 0.5 part by weight of dimethyltriamine-thiol and 1.5 parts by weight of pyrogallol in a solvent mixture containing 250 parts by weight of methanol, 190 parts by weight of methyl ethyl ketone and 190 parts by weight of toluene to prepare a resin varnish, followed by coating a PET film with the varnish and drying the coating first at 80° C. for 5 minutes and then at 140° C. for 5 minutes.

Then, the organic resin film obtained above was inserted between copper foil (102) on which current protecting element wiring portions (3) and current protecting elements (4) were to be formed and an insulating spacer (101) which had been prepared by etching off copper foil from both sides of a double-sided copper-clad laminate having a thickness of 0.2 mm (MCL-E-679, a trade name manufactured by Hitachi Chemical Co., Ltd.). Then, holes having a diameter of 0.8 mm were drilled, and lamination was carried out at 170° C. for 60 minutes under a pressure of 50 kg/cm$^2$ to prepare a laminate (100), as shown in FIG. 3C.

Then, as shown in FIG. 4D, thickness of the portions on which current protecting element wiring portions (3) were to be formed was increased by 10 $\mu$m by electroplating of copper.

Then, a pattern of current protecting element wiring portions (3) and current protecting elements (4) was formed by using an electrodeposited resist prepared by electrodepositing an ultraviolet-curabl resist as an etching resist, baking and developing the etching resist, and etching off the unnecessary portions of copper foil (102).

In the pattern thus formed, a plurality of current protecting element wiring portions (3) were arranged in series in the longitudinal direction so as to interpose the current protecting elements (4), and in parallel with one another in the lateral direction, as shown in FIG. 3H.

Apart from the above, an insulating spacer (200) was prepared by etching off the copper foil from both surfaces of double-sided copper-clad laminate having a thickness of 0.2 mm (MCL-E-679, a trade name, manufactured by Hitachi Chemical Co., Ltd.). superposing an adhesive sheet (GF3500, a trade name, manufactured by Hitachi Chemical Co., Ltd.) on both sides of the product obtained above, and drilling holes having a diameter of 0.8 mm by means of a drill for the purpose of forming spaces.

Then, the product on which current protecting element wiring portions (3) and current protecting elements (4) had been formed was superposed on the adhesive layer-carrying laminate (100) having holes (104) so that the positions of holes (104) roughly coincided, and further two sheets of laminates having a thickness of 0.2 mm and carrying a copper foil (18 $\mu$m in thickness) on one side thereof (MCL-E-679, a trade name, manufactured by Hitachi Chemical Co., Ltd.) so that the copper foils (103) both faced outside as shown in FIG. 3D, and lamination was carried out at 180° C. for 90 minutes under a pressure of 50 kg/cm$^2$.

Holes (11) were drilled through the laminated product obtained above, a plating layer (12) was formed to make the inner wall of the holes electrically conductive, and electrodes (2) were formed by etching off the unnecessary copper. Thus, a substrate for chip fuses was prepared.

EXAMPLE 6

As an organic resin layer (103), an organic resin film having a thickness of 50 $\mu$m was prepared by dissolving 120 parts by weight of polyvinyl butyral resin, 74 parts by weight of n-butylated melamine resin, 20 parts by weight of o-cresol novolak type epoxy resin, 1 part by weight of adipic acid, 0.5 part by weight of dimethyltriamine-thiol and 1.5 part by weight of pyrogallol in a solvent mixture containing 250 part by weight of methanol, 190 parts by weight of methyl ethyl ketone and 190 parts by weight of toluene to prepare a resin varnish, followed by coating on a PET film with the varnish and drying the coating first at 80° C. for 5 minutes and then at 140° C. for 5 minutes.

Then, the organic resin film obtained above was inserted between copper foil (102) on which current protecting element wiring portions (3) and current protecting elements (4) were to be formed and insulating spacer (101) which had been prepared by etching off copper foil from both sides of a double-sided copper-clad laminate having a thickness of 0.2 mm (MCL-E-679, a trade name manufactured by Hitachi Chemical Co., Ltd.) and drilling holes having a diameter of 0.8 mm therethrough, and lamination was carried out at 170° C. for 60 minutes under a pressure of 50 kg/cm$^2$ to prepare a laminate (100), as shown in FIG. 3C.

Then, as shown in FIG. 4D, the thickness of the portions corresponding to current protecting element wiring portions (3) was increased by 10 $\mu$m by electroplating of copper.

Then, a filler-containing epoxy resin (CCR-506, a trade name, manufactured by Asahi Kagaku Kenkyusho K. K.) was filled into holes (104) by the method of silk screen printing and cured at 160° C. for 60 minutes.

Then, as an etching resist, an ultravioletcurable resist film (SR-3000, a trade name, manufactured by Hitachi Chemical Co., Ltd.) was laminated, baked and developed, and the unnecessary portions were etched off from copper foil (102) to form a pattern of current protecting element wiring portions (3) and current protecting elements (4).

Then, the resin filling the holes was removed by spraying a 3% by weight aqueous solution of sodium hydroxide at a liquid temperature of 40° C. By this treatment, the resin was swollen, decomposed and removed.

In the pattern thus formed, a plurality of current protecting element wiring portions (3) were arranged in series in the longitudinal direction so as to interpose the current protecting elements (4), and in parallel with one another in the lateral direction, as shown in FIG. 3H.

Apart from the above, an insulating spacer (200) prepared by etching off the copper foil from both sides of a double-sided copper-clad laminate having a thickness of 0.2 mm (MCL-E-679, a trade name, manufactured by Hitachi Chemical Co., Ltd.) was superposed on an adhesive sheet having a thickness of 25 $\mu$m (GF3500, a trade name, manufactured by Hitachi Chemical Co., Ltd.), and holes having a diameter of 0.8 mm were bored therethrough for the sake of forming spaces.

Then, the product on which current protecting element wiring portions (3) and current protecting elements (4) had been formed was superposed on the adhesive-carrying laminate holes obtained above, so that the holes coincides roughly, and further thereon was superposed a single-sided copper-clad (thickness of copper layer: 18 $\mu$m) laminate (thickness of laminate: 0.2 mm) (MCL-E-679, a trade name, manufactured by Hitachi Chemical Co., Ltd.) so that copper foil (301) faced outside, as shown in FIG. 3D, and lamination was carried out at a temperature of 180° C. for 90 minutes under a pressure of 50 kg/cm$^2$.

Holes (11) for connection were drilled through the laminated product and a plating layer (12) was formed to make the inner wall of the holes electrically conductive, and then electrodes (2) were formed by etching off the copper from unnecessary parts. Thus, a substrate for chip fuses was prepared.

EXAMPLE 7

A composite metallic foil constituted of a first copper layer (111) having a thickness of 15 μm, a second copper layer (112) having a thickness of 5 μm and an intermediate nickel-phosphorus alloy layer having a thickness of 0.2 μm was prepared.

A resin varnish was prepared by dissolving 120 parts by weight of polyvinyl butyral resin, 74 parts by weight of n-butylated melamine resin, 20 parts by weight of o-cresol novolak type epoxy resin, 1 part by weight of adipic acid, 0.5 part by weight of dimethyltriamine-thiol and 1.5 part by weight of pyrogallol in a solvent mixture containing 250 part by weight of methanol, 190 parts by weight of methyl ethyl ketone and 190 parts by weight of toluene. The resin varnish thus obtained was coated onto the second copper layer (112) side of the metallic foil obtained above and dried first at 80° C. for 5 minutes and thereafter at 140° C. for 5 minutes to obtain an organic resin layer-carrying copper foil having a thickness of 50 μm, as shown in FIG. 4A.

As shown in FIG. 4B, an insulating spacer (101) prepared by etching off the copper foil from both sides of a double-sided copper-clad laminate having a thickness of 0.2 mm (MCL-E-679, a trade name, manufactured by Hitachi Chemical Co, Ltd.) and drilling holes having a diameter of 0.8 mm therethrough was superposed on the resin-carrying copper foil obtained above so that the resin surfaces faced to each other, and lamination was carried out integrally with heating and pressing at a temperature of 170° C. for 60 minutes under a pressure of 50 kgf/cm$^2$.

Then, the first copper layer (111) was etched off, and the intermediate layer (113) was further etched off to expose the second copper layer (112), as shown in FIG. 4C. Then, unnecessary portions of the second copper layer (112) was etched off in the same manner as in Example 5 to form a plurality of current protecting elements (4), and thickness of the current protecting element wiring portions (3) was increased by 10 μm by the method of electroplating, as shown in FIG. 4D.

Thereafter, the procedure of Example 5 was repeated to prepare a chip fuse substrate.

EXAMPLE 8

A composite metallic foil constituted of a first copper layer (111) having a thickness of 15 μm, a second copper layer (112) having a thickness of 5 μm and an intermediate nickel-phosphorus alloy layer (113) having a thickness of 0.2 μm was prepared A resin varnish was prepared by dissolving 120 parts by weight of polyvinyl butyral resin, 74 parts by weight of n-butylated melamine resin, 20 parts by weight of o-cresol novolak type epoxy resin, 1 part by weight of adipic acid, 0.5 part by weight of dimethyltriamine-thiol and 1.5 part by weight of pyrogallol in the same solvent mixture as in Example 7. The resin varnish thus obtained was coated on the second copper layer (112) side of the metallic foil obtained above, and dried first at 80° C. for 5 minutes and thereafter at 140° C. for 5 minutes to obtain an organic resin layer-carrying copper foil having a thickness of 50 μm, as shown in FIG. 4A.

Then, as shown in FIG. 4B, an insulating spacer (101) was prepared by etching off the copper foil from both sides of a double-sided copper-clad laminate having a thickness of 0.2 mm (MCL-E-679, a trade name, manufactured by Hitachi Chemical Co., Ltd.) and drilling holes having a diameter of 0.8 mm. The insulating spacer thus obtained was superposed on the resin-carrying copper foil obtained above so that the resin surfaces faced to each others and lamination was carried out integrally at a temperature of 170° C. for 60 minutes under a pressure of 50 kgf/cm$^2$.

Then, the first copper layer (111) was etched off from the portions other than the areas expected to form current protecting element wiring portions (3), and the exposed intermediate layer (113) was removed to expose the second copper layer (112), after which unnecessary portions of the second copper layer (112) were etched off to form a plurality of current protecting elements (4), as shown in FIG. 4E.

Thereafter, the procedure of Example 5 was repeated to prepare a chip fuse substrate.

Then, as shown in FIG. 3J, the chip fuse substrates obtained in Examples 5–8 were cut so as to give current protecting element units.

The current protecting elements thus formed had a conductor width of 0.05 mm, and resistance thereof was about 180 mΩ.

Clearing test was carried out on 20 test pieces for every sample. As a result, the resistance after clearing was more than 10 megohms, and on the level of gigaohm in most cases.

No ignition nor smoking was observed in all the samples.

As has been mentioned above, the chip fuse of the present invention is free from the risk of ignition and smoking. Further, it enables an exact formation of wiring and makes it possible to control the continuity resistance of current protecting elements. Further, since the fuse is constituted of a copper foil having so small a thickness as 3–8 μm, the chip fuse can fuse with a high sensitivity to overcurrent and exhibits excellent clearing characteristics. Further, the chip fuse of the present invention is excellent in the insulating characteristics after clearing, too.

What is claimed is:

1. A chip fuse comprising an organic resin-made insulating substrate, a pair of electrodes formed at terminals of said organic resin-made insulating substrate, and current protecting element wiring portions and a current protecting element positioned between said pair of electrodes and housed in said organic resin-made insulating substrate, said current protecting element having a thickness of 3–8 μm and being supported on an organic resin layer having a high tracking resistance, and at least one space being formed at least on the current protecting element side over said current protecting element and an insulating spacer overlying said current protecting element wiring portions and said current protecting element so as to provide said space on the current protecting element side.

2. A chip fuse according to claim 1, wherein said organic resin layer having a high tracking resistance and supporting the current protecting element comprises a polyvinyl butyral resin, a n-butylated melamine resin, an o-cresol novolak type epoxy resin, adipic acid, dimethyltriamine-thiol and pyrogallol.

3. A chip fuse according to claim 1, wherein a thickness of said current protecting element wiring portions is in the range of from 10 μm to 50 μm.

4. A chip fuse according to claim 1, wherein said space is provided only on the current protecting element side.

5. A chip fuse according to claim 1, wherein said space is provided both on the current protecting element side and on the organic resin layer side, said space on the organic resin layer side being between the organic resin layer and the organic resin-made insulating substrate.

6. A process for producing a chip fuse of claim 4, which comprises:

a) a step of forming an organic resin layer having a high tracking resistance on one side of copper foil having a thickness of 3–8 μm and laminating a substrate having copper foil on the organic resin layer side thereof to prepare a laminate;

b) a step of etching off unnecessary portions of the copper foil of the laminate and thereby forming a plurality of current protecting element wiring portions and current protecting elements;

c) apart from the above-mentioned steps, a step of preparing an insulating spacer having holes;

d) a step of superposing the insulating spacer having holes prepared in Step c) onto the current protecting element side of the laminate prepared in Step b) on which current protecting element wiring portions and current protecting elements have been formed, and further superposing thereon a laminate prepared by forming an insulating layer on one side of a copper foil so that the insulating layer comes into contact with the insulating spacer, followed by carrying out lamination;

e) a step of boring holes through the laminated product so that the holes pass through the current protecting element wiring portions;

f) a step of plating the laminated product having holes and thereby making the inner walls of the holes electrically conductive;

g) a step of etching off unnecessary portions of the copper and thereby forming electrodes connected to the conductive material formed on the inner walls of the holes; and h) a step of cutting the holes in the longitudinal direction and thereby dividing the assembly into individual chip fuses in which the cutout pieces of the holes function as terminal electrodes.

7. A process according to claim 6, which further comprises, between Steps a) and b), a step of forming a plating layer of 10 to 50 μm on the portions of the copper foil having a thickness of 3–8 μm expected to form current protecting element wiring portions.

8. A process for producing a chip fuse of claim 4, which comprises:

a1) a step of preparing a laminate by coating an organic resin varnish onto the second copper layer side of a composite metallic foil constituted of a first copper layer having a thickness of 10–50 μm, a second copper layer having a thickness of 3–8 μm and an intermediate layer made of nickel or an alloy thereof and having a thickness of 1 μm or less, said intermediate layer being positioned between the two copper layers, and drying the coating to form an organic resin layer having a high tracking resistance so that the organic resin layer comes into contact with the substrate, and further laminating thereon a copper foil;

a2) a step of etching off only the first copper layer;

a3) a step of further etching off only the intermediate layer;

b1) a step of etching off unnecessary portions of the second copper layer and thereby forming a plurality of current protecting element wiring portions and current protecting elements;

c) apart from the above-mentioned steps, a step of preparing an insulating spacer having holes;

d1) a step of superposing the insulating spacer having holes prepared in Step c) onto the current protecting element side of the product on which current protecting element wiring portions and current protecting elements have been formed in Step b1), further superposing thereon a laminate prepared by forming an insulating layer on one side of a copper foil so that the insulating layer comes into contact with the insulating spacer, and then carrying out lamination;

e) a step of boring holes so that the holes pass through the current protecting element wiring portions of the laminated product;

f) a step of plating the laminated product having holes and thereby making the inner walls of the holes electrically conductive;

g) a step of etching off the copper of the unnecessary portions and thereby forming electrodes connected to the conductive material formed on the inner walls of the holes; and h) a step of cutting the holes in the longitudinal direction and thereby dividing the assembly into individual chip fuses in which the cutout pieces of the holes function as terminal electrodes.

9. A process according to claim 8, which further comprises, between Steps a3) and b1), a step of forming a plating layer of 10 to 50 μm on the portions of the copper foil having a thickness of 3–8 μm expected to form current protecting element wiring portions.

10. A process for producing a chip fuse of claim 4, which comprises:

a1) a step of preparing a laminate by coating an organic resin varnish onto the second copper layer side of a composite metallic foil constituted of a first copper layer having a thickness of 10–50 μm, a second copper layer having a thickness of 3–8 μm and an intermediate layer made of nickel or an alloy thereof and having a thickness of 1 μm or less, said intermediate layer being positioned between the two copper layers, and drying the coating to form an organic resin layer having a high tracking resistance, followed by laminating the organic resin layer-carrying composite metallic layer thus formed onto a substrate so that the organic resin layer comes into contact with the substrate, further laminating thereon a copper foil, and carrying out lamination;

a4) a step of etching off at least the portions expected to form current protecting elements from the first copper layer;

a5) a step of further etching off the portions which have been exposed in Step a4) from the intermediate layer of the composite metallic foil;

b2) a step of etching off unnecessary portions from the second copper layer and thereby forming current protecting element wiring portions and current protecting elements;

c) apart from the above-mentioned steps, a step of preparing an insulating spacer having holes;

d2) a step of superposing the insulating spacer having holes prepared in Step c) on the current protecting element side of the product on which current protecting element wiring portions and current protecting elements have been formed in Step b2), further superposing thereon a laminate prepared by forming an insulating layer on one side of a copper foil so that the insulating layer comes into contact with the insulating spacer, and carrying out lamination;

e) a step of boring holes so that the holes pass through the current protecting element wiring portions of the laminated product;

f) a step of forming a plating layer on the laminated product having holes obtained above to make the inner walls of the holes electrically conductive;

g) a step of etching off the copper from the unnecessary portions and thereby forming electrodes connected to the conductive material on the inner walls of the holes; and h) a step of cutting the holes in the longitudinal direction and thereby dividing the assembly into individual chip fuses in which the cutout pieces of the holes function as terminal electrodes.

11. A process for producing a chip fuse of claim 5, which comprises:

a') a step of preparing an insulating spacer having holes;

b') a step of preparing a laminate by laminating the insulating spacer having holes obtained above onto the organic resin layer side of a product prepared by forming an organic resin layer having a high tracking resistance on one side of a copper foil having a thickness of 3–8 $\mu$m and thereby preparing a laminate;

c') a step of etching off unnecessary portions of the copper foil of the laminate obtained above and thereby forming a plurality of current protecting element wiring portions and current protecting elements;

d') apart from the above-mentioned steps, a step of preparing an insulating spacer having holes;

e') a step of superposing the insulating spacer having holes prepared in Step d') on the current protecting element side of the laminate on which current protecting element wiring portions and current protecting elements have been formed in Step c'), further superposing thereon a laminate prepared by forming an insulating layer on one side of a copper foil so that the insulating layer comes into contact with the insulating spacer, and carrying out lamination;

f') a step of boring holes so that the holes pass through the current protecting element wiring portions of the laminated product;

g') a step of plating the laminated product having holes to make the inner walls of the holes electrically conductive;

h') a step of etching off the copper of unnecessary portions and thereby forming electrodes connected to the conductive material on the inner walls of the holes; and i') a step of cutting the holes in the longitudinal direction and thereby dividing the assembly into individual chip fuses in which the cutout pieces of the holes function as terminal electrodes.

12. A process according to claim 11, which further comprises, between Steps b') and c'), a step of forming a plating layer of 10 to 50 $\mu$m thick on the portions expected to form current protecting element wiring portions of copper foil having a thickness of 3–8 $\mu$m.

13. A process for producing a chip fuse of claim 5, which comprises:

a') a step of preparing an insulating spacer having holes;

b1') a step of preparing a laminate by coating an organic resin varnish onto the second copper layer side of a composite metallic foil constituted of a first copper layer having a thickness of 10–50 $\mu$m, a second copper layer having a thickness of 3–8 $\mu$m and an intermediate layer made of nickel or an alloy thereof and having a thickness of 1 $\mu$m or less, said intermediate layer being positioned between the two copper layers, and drying the varnish to form an organic resin layer having a high tracking resistance, followed by carrying out lamination so that the organic resin layer comes into contact with the insulating spacer having holes;

b2') a step of etching off only the first copper layer;

b3') a step of further etching off only the intermediate layer;

c1') a step of etching off the unnecessary portions of the second copper layer and thereby forming a plurality of current protecting element wiring portions and current protecting elements;

d') apart from the above-mentioned steps, a step of preparing an insulating spacer having holes;

e1') a step of superposing the insulating spacer having holes prepared in Step d') on the current protecting element side of the product on which current protecting element wiring portions and current protecting elements have been formed in Step c1'), further superposing thereon a laminate prepared by forming an insulating layer on one side of a copper foil so that the insulating layer comes into contact with the insulating spacer, and then carrying out lamination;

f') a step of boring holes through the laminated product so that the holes pass through the current protecting element wiring portions;

g') a step of plating the laminated product having holes to make the inner walls of the holes electrically conductive;

h') a step of etching off the copper of the unnecessary portions to form electrodes connected to the conductive material of the inner walls of the holes; and i') a step of cutting the holes in the longitudinal direction and thereby dividing the assembly into individual chip fuses so that the cutout pieces of the holes function as terminal electrodes.

14. A process according to claim 13, which further comprises, between Steps b3') and c1'), a step of forming a plating layer of 10 to 50 $\mu$m thick on the portions expected to form current protecting element wiring portions of the copper foil having a thickness of 3–8 $\mu$m.

15. A process for producing a chip fuse of claim 5, which comprises:

a') a step of preparing an insulating spacer having holes;

b1') a step of preparing a laminate by coating an organic resin varnish onto the second copper layer side of a composite metallic foil constituted of a first copper layer having a thickness of 10–50 $\mu$m, a second copper layer having a thickness of 3–8 $\mu$m and an intermediate layer made of nickel or an alloy thereof and having a thickness of 1 $\mu$m or less, said intermediate layer being positioned between the two copper layers, and drying to form an organic resin layer having a tracking resistance, and then carrying out lamination so that the organic resin layer comes into contact with the insulating spacer having holes;

b4') a step of etching off at least the portions expected to form current protecting elements from the first copper layer;

b5') a step of further etching off the portions exposed in Step b4') from the intermediate layer of the composite metallic foil;

c2') a step of etching off unnecessary portions from the second copper layer and thereby forming current protecting element wiring portions and current protecting elements;

d') apart from the above-mentioned steps, a step of preparing an insulating spacer having holes;

e2') a step of superposing the insulating spacer having holes prepared in Step d') on the current protecting element side of the product on which current protecting element wiring portions and current protecting elements have been formed in Step c2'), further superposing thereon a laminate prepared by forming an insulating layer on one side of a copper foil so that the insulating layer comes into contact with the insulating spacer, and then carrying out lamination;

f') a step of boring holes so that the holes pass through the current protecting element wiring portions of the laminated product;

g') a step of forming a plating layer on the laminated product having holes to make the inner walls of the holes electrically conductive;

h') a step of etching off copper from unnecessary portions to form electrodes connected to the conductive material on the inner walls of the holes; and i') a step of cutting the holes in the longitudinal direction and thereby dividing the assembly into individual chip fuses in which the cutout pieces of the holes function as terminal electrodes.

16. A chip fuse according to claim 1, wherein the tracking resistance of said organic resin layer is of PLC-O class.

17. A chip fuse according to claim 1, wherein said organic resin layer is provided on said organic resin-made insulating substrate.

18. A chip fuse according to claim 1, wherein said organic resin layer has a thickness of 5–200 $\mu$m.

19. A chip fuse according to claim 5, further comprising insulating spacers respectively (a) overlying said current protecting element wiring portions and current protecting element and (b) positioned between said insulating resin layer and said insulating substrate, so as to provide said space both on the current protecting element side and on the organic resin layer side.

20. A chip fuse according to claim 4, wherein the space is provided only on the current protecting element side so as to prevent surfaces of said current protecting element, except for the surface supported on the organic resin layer from contacting with an insulating spacer.

21. A chip fuse according to claim 5, wherein the space provided on the current protecting element side is formed so as to prevent surfaces of said current protecting element, except for the surface supported on the organic resin layer, from contacting with an insulating spacer.

* * * * *